US005307781A

United States Patent [19]

Nakada et al.

[11] Patent Number: 5,307,781

[45] Date of Patent: May 3, 1994

[54] CAM SHAFT FOR FUEL INJECTION PUMP

[75] Inventors: Teruo Nakada; Yuichi Murata; Naoyuki Soma, all of Fujisawa, Japan

[73] Assignee: Isuzu Motors Limited, Tokyo, Japan

[21] Appl. No.: 874,234

[22] Filed: Apr. 24, 1992

[30] Foreign Application Priority Data

Apr. 30, 1991 [JP] Japan ..... 3-098999

[51] Int. Cl.[5] ..... F02M 37/04; F02M 59/00

[52] U.S. Cl. ..... 123/495; 123/496

[58] Field of Search ..... 123/495, 496, 504, 446

[56] References Cited

U.S. PATENT DOCUMENTS

| | | | |
|---|---|---|---|
| Re. 30,189 | 1/1980 | Perr | 123/496 |
| 3,951,117 | 4/1976 | Perr | 123/496 |
| 4,308,839 | 1/1982 | Hafner | 123/496 |
| 4,478,196 | 10/1984 | Hafner | 123/496 |
| 5,094,215 | 3/1992 | Gustafson | 123/496 |
| 5,094,216 | 3/1992 | Miyaki | 123/496 |

FOREIGN PATENT DOCUMENTS

| | | | |
|---|---|---|---|
| 3620902 | 12/1987 | Fed. Rep. of Germany | 123/495 |
| 3925823 | 6/1990 | Fed. Rep. of Germany . | |
| 808054 | 1/1937 | France . | |
| 2439307 | 5/1980 | France . | |
| 0100323 | 4/1989 | Japan | 123/495 |
| 0164563 | 7/1991 | Japan | 123/495 |
| 343420 | 2/1931 | United Kingdom . | |

*Primary Examiner*—Carl S. Miller

*Attorney, Agent, or Firm*—Dykema Gossett

[57] ABSTRACT

A cam shaft reduces noise produced by gears used to drive cams of a fuel injection pump. Conventionally, the gear noises are caused by negative torque of a cam shaft. A cam profile of each cam which lifts a plunger of the fuel injection pump is shaped like a fan. There are formed two cams in a single cam shaft. A lift increment segment of a first cam overlaps a lift decrement segment of a second cam to prevent a negative torque.

7 Claims, 3 Drawing Sheets

CAM SHAFT FOR FUEL INJECTION PUMP

BACKGROUND OF THE INVENTION

1. Technical Field

The present invention relates to a cam shaft for a fuel injection pump provided in an in-line internal combustion engine.

2. Background Art

As shown in FIG. 3 of the accompanying drawings, a fuel injection pump 1 of an in-line internal combustion engine (diesel engine) includes a plunger 2 for pressurizingly delivering fuel, a delivery valve 4 located between a fuel injection tube 3 and the plunger 2, a control sleeve 5 and a control rack 6. The control sleeve 5 and control rack 6 control, in combination, an amount of fuel injected. The plunger 2 contacts a cam 8 of a cam shaft 7 via a tappet 9 and the fuel injection pump 1 reciprocates up and down in accordance with a cam profile to inject fuel of predetermined pressure.

Incidentally, the cam profile P of the conventional cam shaft 7 has a lift increment segment 11 and a lift decrement segment 12. The lift increment segment 11 linearly reaches a maximum lift position 10 and the lift decrement segment 12 gently returns to a zero-lift position from the maximum lift position 10. Therefore, as shown in FIG. 4, the drive torque of the cam 8 has a positive area 13 (a torque indicated by "A" in the illustration is added) in which a tappet 9 is lifted during the lift increment section 11 so as to pressurizingly transfer the fuel and a negative area 15 in which a spring force from a spring 14 pressing the tappet 9 against the cam 8 acts during the lift decrement section 12. In case of a plural-cylinder engine, plungers 2 of the same number as the cylinders are provided and the cams 8 have different phases to move the plungers 2 at predetermined timings.

Incidentally, since the period of the positive and negative areas 13 and 15 of each cam 8 is short, positive and negative torques appear in a single cam shaft 7.

Because of this, as shown in FIG. 5, particularly in the case of a gear-driven diesel engine, each time the torque fluctuates between the positive and negative area, a contact face 18 of a gear 16 of the fuel injection pump side with a gear 17 of the drive side moves backward (clockwise in the drawing) by a gear lash as indicated by a double dot line, thereby raising the problem that a gear noise is produced.

SUMMARY OF THE INVENTION

An object of the present invention is to provide a cam shaft for a fuel injection pump which can reduce noise produced by gears of a fuel pump.

According to one aspect of the present invention, there is provided a cam shaft for driving a plunger of a fuel injection pump provided for each cylinder of an internal combustion engine characterized in that the cam shaft comprises a first cam having a cam profile of nearly fan shape for lifting the plunger and a second cam having a cam profile of nearly fan shape symmetrical to the first cam with respect to the cam shaft center.

Each cam has a lift increment segment and a lift decrement segment, and the lift increment segment of the first cam overlaps the lift decrement segment of the second cam and the lift decrement segment of the second cam overlaps the lift increment segment of the second cam.

With this cam shaft, the drive torque for the cam shaft does not fluctuate or become constant and the negative area does not appear. Since the drive torque does not have the negative area, the gear noise due to the gear contact face change is greatly reduced.

These and other objects, aspects and advantages of the present invention will become more apparent as the following detailed description is read with the attached drawings and the claims.

DETAILED DESCRIPTION OF THE PREFERRED EMBODIMENTS

Now, an embodiment of the present invention will be described with reference to FIGS. 1 and 2 of the accompanying drawings.

Figure 1:
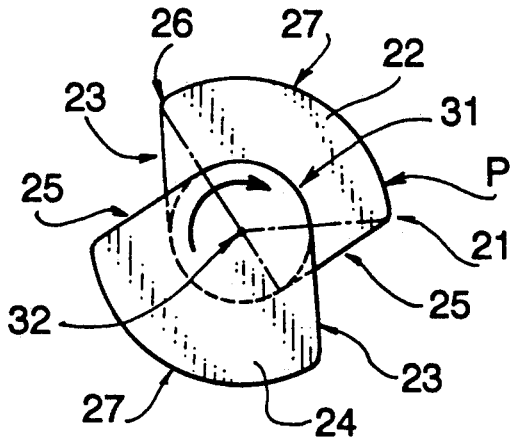
FIG. 1 is a view of a cam shaft of a fuel injection pump according to one embodiment of the present invention as viewed in an axial direction of the cam shaft.

Referring to FIG. 1, a cam 21 of a cam shaft which drives a plunger provided for each cylinder of a four cylinder engine has a nearly fan-shaped profile P. Although only one cam 21 is seen in FIG. 1, the cam shaft has another cam in its axial direction (direction perpendicular to the drawing sheet). The cam 21 includes a first cam 22 and a second cam 24. A lift increment segment 23 of the first cam 22 overlaps a lift decrement segment 25 of the second cam 24 by a predetermined amount or in a proper way. In this particular embodiment, the first cam 22 serves the #2 cylinder of the four cylinder diesel engine and the second cam 24 serves the #3 cylinder.

The profile P of the cam 21 is in turn comprised of a lift increment segment 23 which linearly rises to a maximum lift position 26 from a zero lift position (true circle 31), a lift maintenance segment 27 which maintains the maximum lift position 26 and a lift decrement segment 25 which linearly drops from the maximum lift position 29 to the zero lift position. The lift increment and decrement segments 23 and 25 are respectively defined by tangential lines of the circle 31 (zero lift line) and the lift maintenance segment 27 is defined by an arc of which center is a center axis 32 of the cam shaft. A combination of these segments 23, 27 and 25 forms an angle of beyond 180 degrees as viewed from the center 32 of the cam shaft.

Figure 2:
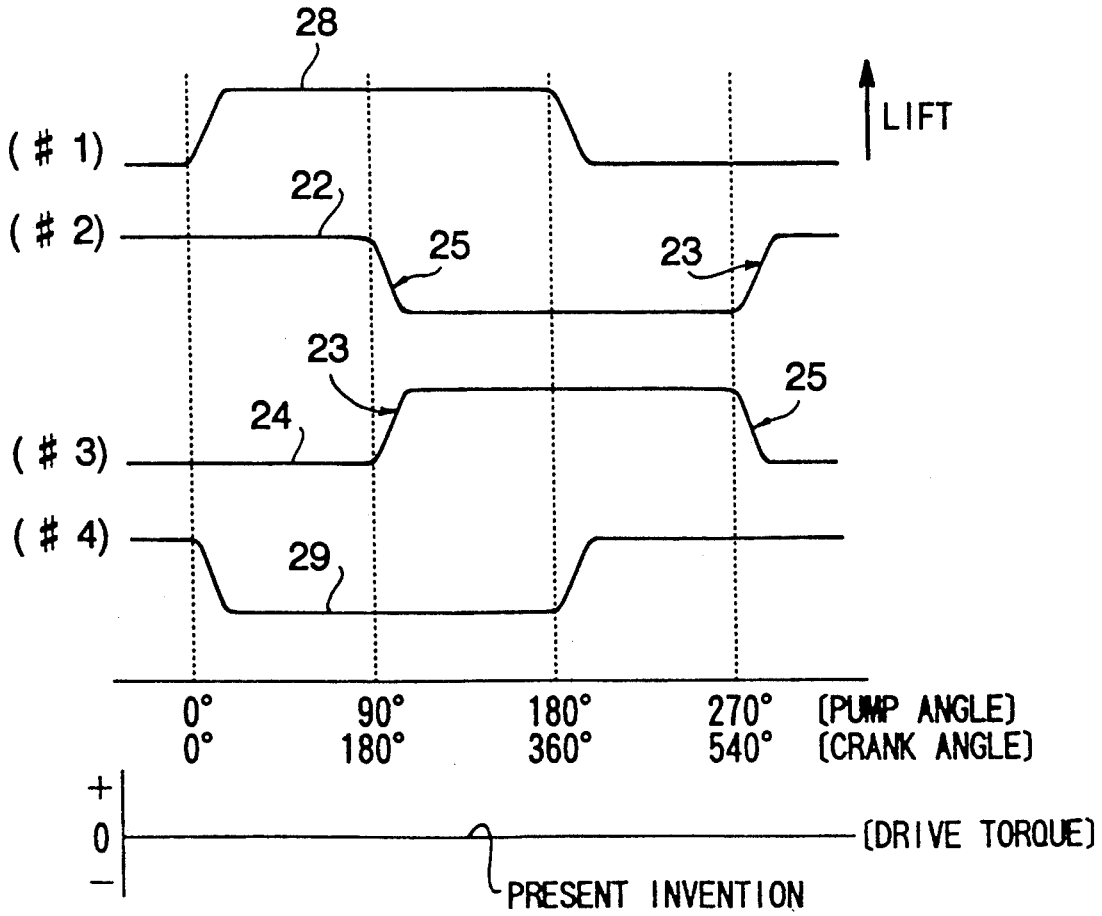
FIG. 2 is a set of views showing cam lift curves of the cam shaft of FIG. 1.
Figure 3:
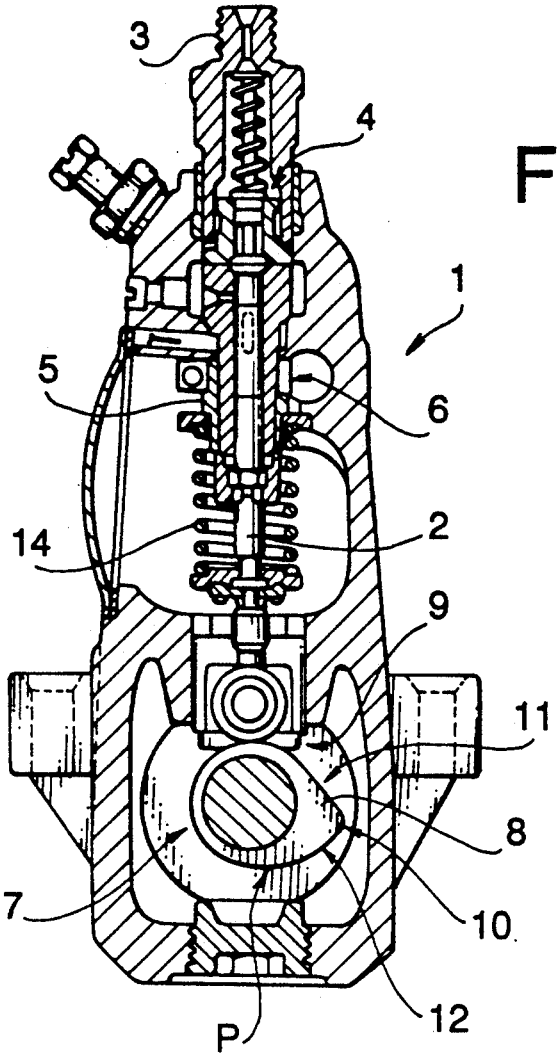
FIG. 3 is a sectional view of a conventional fuel injection pump.
Figure 4:
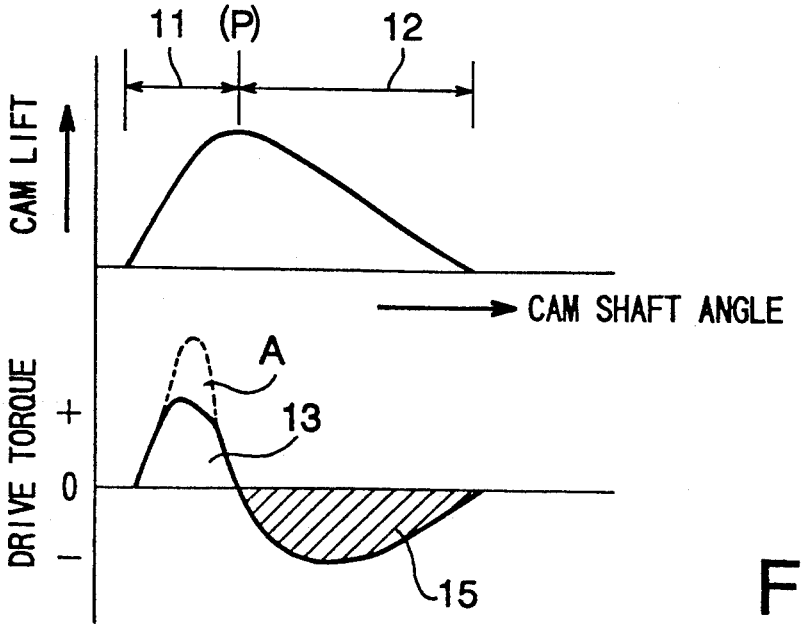
FIG. 4 shows changes of cam lift and drive torque of the fuel injection pump employing a conventional cam shaft.
Figure 5:
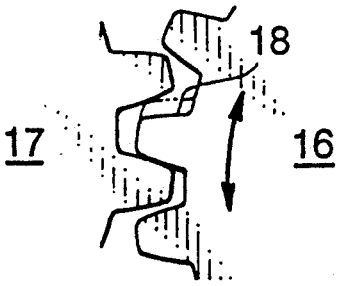
FIG. 5 shows a sectional view of gears of the conventional fuel injection pump.

As understood from FIG. 2, numeral 28 indicates another first cam (for #4 cylinder) and numeral 29 indicates another second cam (for #1 cylinder). The cam 29 is symmetrical with the cam 28. Phases of the cams are determined as follows: The cams 22 and 24 for the inside cylinders (#2 and #3 cylinders) are phase shifted by 180 degrees from the cams 28 and 29 for the outside cylinders (#1 and #4 cylinders). Specifically, where the cams 22 and 24 of FIG. 1 are considered, if the pump angle is 90 degrees, the #2 cylinder cam 22 is in the lift decrement section 25 and the #3 cylinder cam 24 is in the lift increment section 23, and if the pump angle is 270 degrees, the #2 cylinder cam 22 is in the lift increment section 23 and the #3 cylinder cam 24 is in the lift decrement section 25.

With this arrangement, as shown in FIG. 2, the drive torque becomes constant (zero) since the positive and negative areas produced by one cam 21 are counterbalanced by those produced by the other cam. Therefore, unlike the conventional cam shaft, the drive torque of the cam shaft according to the present invention does not include the negative area. Consequently, the gear contact face change due to the positive and negative drive torque fluctuation is prevented and the gear noise is remarkably reduced.

An allocation (length ratio) of the segments 23, 27 and 25 of the cam profile P is determined by a fuel injection pump and/or various performances and dimensions of the internal combustion engine.

Figure 6:
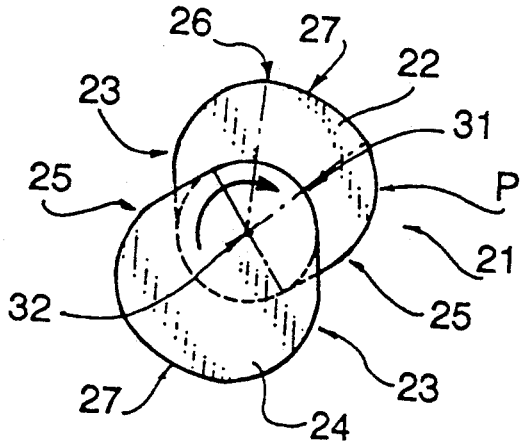
FIGS. 6 and 7 respectively show modifications of cam profile.
Figure 7:
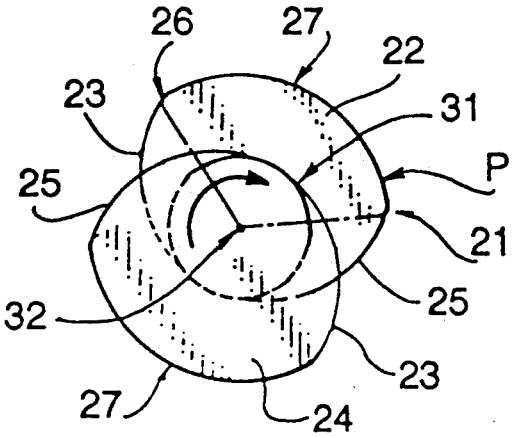

The present invention is not limited to the above described embodiment. For example, FIG. 2 shows that the drive torque curve is horizontal. However, the drive torque curve may fluctuate up and down as long as the minimum torque is not the negative torque. In addition, the torque curve may have a certain positive value other than zero. In other words, if the drive torque does not drop into the negative area, any torque curve may be satisfactory to eliminate the problem of the conventional arrangement. Further, the lift increment segment 23 and the lift decrement segment 25 have a linear profile. However, they may have non-linear profiles respectively, as shown in FIG. 6 or FIG. 7.

What is claimed is:

1. A cam shaft having at least two cams, each cam driving a plunger of fuel injection pump provided for each cylinder of an internal combustion engine, the cam shaft having a longitudinal direction, comprising:

a first cam formed on the cam shaft and having a first cam profile of nearly fan shape for lifting a first plunger, the first cam profile having a first lift increment segment, a first lift decrement segment and a first maximum lift maintenance segment connecting the first lift increment and decrement segments; and a second cam formed on the shaft and having a second cam profile of nearly fan shape symmetrical with the first cam with respect to a center of the cam shaft for lifting a second plunger, the second cam being spaced from the first cam in the longitudinal direction of the cam shaft, the second cam profile having a second lift increment segment, a second lift decrement segment and a second maximum lift maintenance segment connecting the second lift increment and decrement segments, the first lift increment segment overlapping the second lift decrement segment as viewed in the longitudinal direction of the cam shaft such that torque produced by the first lift increment segment is counterbalanced by the second lift decrement segment, and the first lift decrement segment overlapping the second lift increment segment as viewed in the longitudinal direction of the cam shaft such that torque produced by the second lift increment segment is counterbalanced by the first lift decrement segment.

2. The cam shaft of claim 1, wherein the maximum lift maintenance segment is defined by an arc drawn of which center is a center of the cam shaft.

3. The cam shaft of claim 2, wherein the internal combustion engine is a four cylinder diesel engine.

4. The cam shaft of claim 3, further including another first cam and another second cam, and wherein the first cam is a cam for a #2 cylinder of the four cylinder diesel engine, the second cam is a cam for a #3 cylinder and the second cam is 180 degree phase shifted from the first cam, the another first cam is a cam for a #4 cylinder and the another second cam is a cam for a #1 cylinder and the another second cam is 180 degree phase shifted from the another first cam.

5. The cam shaft of claim 4, wherein the cam profile extends over 180 degrees as measured from the center of the cam shaft.

6. The cam shaft of claim 1, wherein the cam profile includes a non-linear lift increment segment, a non-linear lift decrement segment and an arcuate maximum lift maintenance segment connecting the lift increment and decrement segments.

7. The cam shaft of claim 3, wherein the lift increment and decrement segments are respectively defined by non-linear lines connecting a maximum lift position with a true circle defining a zero lift position.

* * * * *